US007434409B2

(12) United States Patent
Gedeon

(10) Patent No.: US 7,434,409 B2
(45) Date of Patent: Oct. 14, 2008

(54) PULSE TUBE COOLER HAVING ¼ WAVELENGTH RESONATOR TUBE INSTEAD OF RESERVOIR

(75) Inventor: David R. Gedeon, Athens, OH (US)

(73) Assignee: Sunpower, Inc., Athens, OH (US)

( * ) Notice: Subject to any disclaimer, the term of this patent is extended or adjusted under 35 U.S.C. 154(b) by 329 days.

(21) Appl. No.: 11/209,984

(22) Filed: Aug. 23, 2005

(65) Prior Publication Data

US 2007/0044484 A1 Mar. 1, 2007

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS 3,237,421 A 3/1966 Gifford
4,722,201 A * 2/1988 Hofler et al. ..... 62/467
5,794,450 A 8/1998 Alexander
5,901,556 A * 5/1999 Hofler ..... 62/6
6,256,998 B1 7/2001 Gao
6,578,364 B2 * 6/2003 Corey ..... 62/6
6,865,894 B1 * 3/2005 Olson ..... 62/6
2003/0196441 A1 10/2003 Switf et al.
2003/0226364 A1 12/2003 Swift et al.
2004/0000149 A1 1/2004 Kirkconnell et al.

* cited by examiner

*Primary Examiner*—William C Doerrler
(74) *Attorney, Agent, or Firm*—Frank H. Foster; Kremblas, Foster, Phillips & Pollick

(57) ABSTRACT

An improved pulse tube cooler having a resonator tube connected in place of a compliance volume or reservoir. The resonator tube has a length substantially equal to an integer multiple of ¼ wavelength of an acoustic wave in the working gas within the resonator tube at its operating frequency, temperature and pressure. Preferably, the resonator tube is formed integrally with the inertance tube as a single, integral tube with a length approximately ½ of that wavelength. Also preferably, the integral tube is spaced outwardly from and coiled around the connection of the regenerator to the pulse tube at a cold region of the cooler and the turns of the coil are thermally bonded together to improve heat conduction through the coil.

8 Claims, 2 Drawing Sheets

PULSE TUBE COOLER HAVING ¼ WAVELENGTH RESONATOR TUBE INSTEAD OF RESERVOIR

(a) STATEMENT REGARDING FEDERALLY-SPONSORED RESEARCH AND DEVELOPMENT

This invention was made with Goverment support under contact NAS5-02021 awarded by NASA. The Goverment has certain rights in this invention.

(b) CROSS-REFERENCE TO RELATED APPLICATIONS (Not Applicable)

(c) REFERENCE TO AN APPENDIX (Not Applicable)

(d) BACKGROUND OF THE INVENTION

1. Field of the Invention

This invention relates generally to pulse tube cryocoolers and more particularly to a structure that can be substituted for the reservoir that is used in common configurations and thereby reduce cost, working gas volume, weight and cool down time.

2. Description of the Related Art

Traveling wave pulse tube coolers have been recognized as having desirable characteristics for cooling to cryogenic temperatures, particularly when multiple coolers are cascaded in stages. Their development began with the study of the cooling effects resulting from the application of a pressure wave to one end of a tube that was closed at its opposite end. A regenerator was added to the tube and an example is illustrated in U.S. Pat. No. 3,237,421. The art recognized that the time phasing between the pressure and the working gas mass flow velocity in the regenerator was critical to the heat pumping efficiency of the cooler. A dramatic improvement in performance resulted from the addition of an orifice, at the formerly closed end of the tube, with the orifice leading to a relatively large volume reservoir, also referred to as a surge volume, compliance volume or buffer. This orifice pulse tube cooler greatly improved the phasing in the regenerator thereby increasing heat pumping efficiency. Numerous examples of the orifice pulse tube cooler exist in the prior art of which U.S. Pat. No. 5,794,450 is only one example.

The orifice and reservoir changed the acoustic impedance at the end of the tube and thereby changed the phase relationship between gas velocity and pressure. At the wall of a closed end of a tube, the boundary condition velocity is always zero while the pressure oscillates and therefore the closed end has a pressure anti-node and a velocity node. The closed end presents a nearly pure reactive impedance to the tube, with the pressure and velocity essentially 90° out of phase and reflecting energy. An orifice, however, when connected to a large volume, that is sufficiently large that it does not undergo any significant pressure variation, allows gas to flow in oscillating directions through the orifice unaffected by a pressure change in the reservoir (because there is none) and allows pressure variations across the orifice, if the orifice is not too large. Consequently, the combined orifice and reservoir can be designed to present a resistive acoustic impedance to the tube. The resistive impedance has the characteristic that the pressure and velocity of the gas at the orifice are in phase. The phasing change at the end of the tube resulting from substitution of the orifice and reservoir for the closed end wall resulted in a desired change in the phasing in the reservoir ultimately resulting in the improved heat pumping efficiency.

Pulse tube coolers have also been configured with multiple cascaded stages as illustrated in U.S. Pat. No. 6,256,998 and U.S. Pub. 2004/0000149.

The traveling wave pulse tube cooler was further improved by substitution of an inertance tube for the orifice. An example of this configuration is illustrated in U.S. Pub. 2003/0226364. The inertance tube is a long narrow tube, typically a few meters long, that is open at each end and can be wound in a coil. The inertance tube is connected between, and inserts a reactive acoustic impedance between, the reservoir and the pulse tube. When connected in this manner to the pulse tube and cut to approximately ¼ wavelength of the acoustic wave, this combination presents a nearly resistive acoustic impedance to the end of the pulse tube. Using an inertance tube instead of an orifice, a designer can, by varying the length of the inertance tube, vary the acoustic impedance, and therefore the pressure/velocity phasing, at the end of the pulse tube. This permits the designer more flexibility to further adjust and optimize the phasing in the regenerator and thereby further increase the heat pumping efficiency.

The reservoir, however, also has some undesirable characteristics. The reservoir must enclose a large volume that is sufficiently large that the pressure of the gas within it does not vary appreciably throughout an acoustic cycle. Furthermore, the reservoir must be sufficiently strong that it will retain the working gas under the average pressure to which the pulse tube cooler is charged. Therefore, the reservoir must be structurally configured and have both its surface area and its thickness sufficiently large to meet these requirements. As a consequence the reservoir has a large mass, has a large volume occupying considerable space, is relatively heavy and is relatively expensive to manufacture.

Additionally, in multi-stage pulse tube cryocoolers, the upper stages (stages beyond the first stage) operate in their steady state at reduced temperatures. In some implementations, the reservoir and inertance tube for an upper stage operates at the temperature of its warm region or "end" which is at the temperature of the cold region or "end" of the preceding stage. Therefore, under transient conditions when the cryocooler is cooling down to its operating temperature, the pulse tube cooler stages must cool down the reservoir as well as other components. The relatively large mass of the reservoir, and its consequent high heat storage capacity, causes a substantial time delay until the cryocooler reaches operating temperature.

It is therefore an object and feature of the invention to substitute for the reservoir of a pulse tube cooler, a structure having a greatly reduced mass and volume that is also considerably less expensive and easily made from a readily available, common product, and can be more easily contained within the outer vacuum vessel in which cryocoolers are ordinarily housed.

(e) BRIEF SUMMARY OF THE INVENTION

The reservoir of a pulse tube cooler is replaced by a resonator tube that has a length substantially equal to ¼ wavelength of a standing wave in the working gas, or an odd, integer multiple thereof, at the operating frequency, temperature and pressure of the resonator tube. Preferably, the resonator tube is formed integrally with the inertance tube as a single, integral tube serving the functions of both.

(f) BRIEF DESCRIPTION OF THE SEVERAL VIEWS OF THE DRAWINGS

Figure 1:
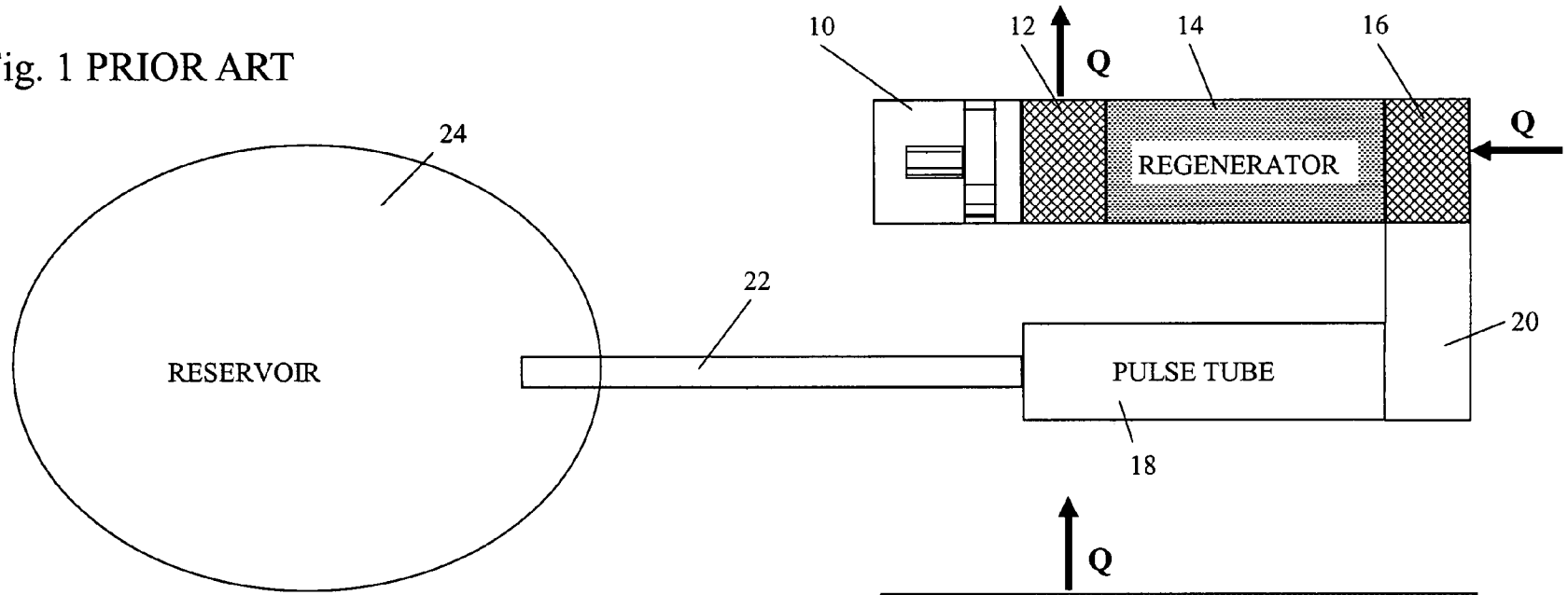
Fig. 1 PRIOR ART
FIG. 1 is a schematic diagram of a prior art pulse tube cooler.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are used. They are not limited to direct connection, but include connection through other elements where such connection is recognized as being equivalent by those skilled in the art. In addition, devices are illustrated which are of a type that perform well known operations. Those skilled in the art will recognize that there are many, and in the future may be additional, alternative devices which are recognized as equivalent because they provide the same operations.

(g) DETAILED DESCRIPTION OF THE INVENTION

Figure 2:
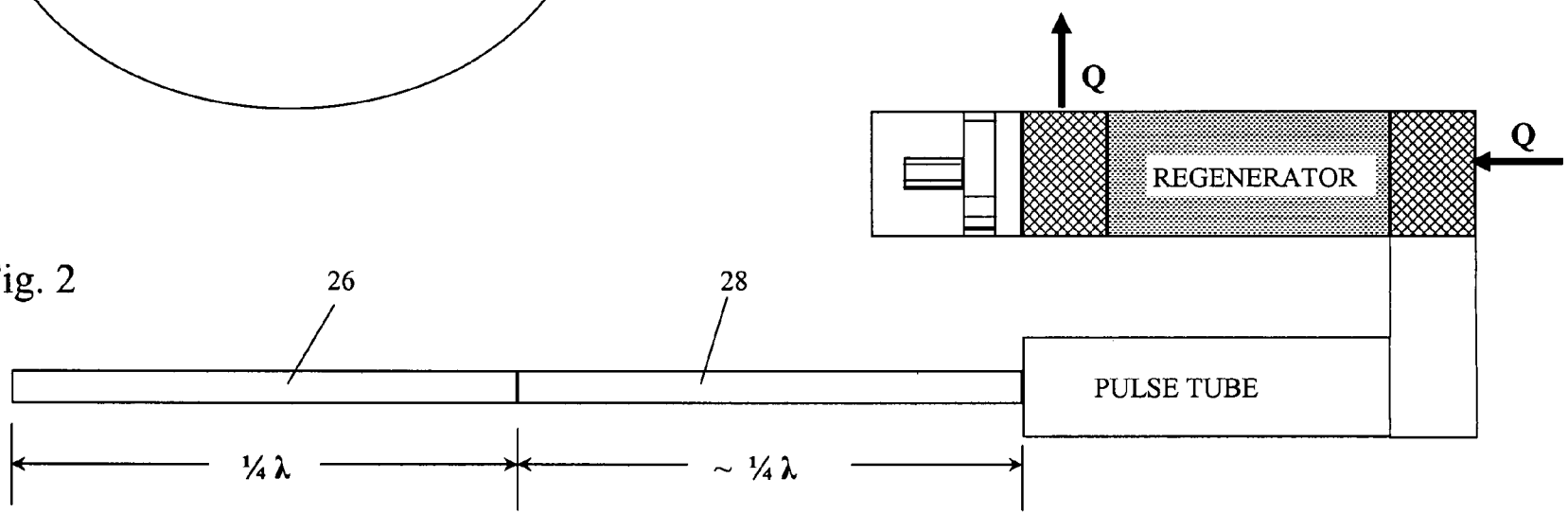
FIG. 2 is a schematic diagram of an embodiment of the invention.

FIGS. 1 and 2 diagrammatically show pulse tube coolers in a U-tube configuration, although the invention is applicable to linear and other configurations. Those Figs. each show a single stage, but, as known in the art, pulse tube coolers can have multiple stages cascaded with the each stage accepting heat from its immediately subsequent higher stage, or if it is the highest stage from the object being cooled, and rejecting heat to its immediately preceding lower stage, or to the ambient atmosphere, if it is the lowest stage. Therefore, the coolers of FIGS. 1 and 2 also represent individual stages of a cryocooler having multiple, cascaded stages.

The pulse tube cooler of FIG. 1 is constructed in accordance with the prior art. A pressure wave generator, having a selected operating frequency such as 30 Hz or 60 Hz, is connected through a heat rejecting heat exchanger 12, a regenerator 14 and a heat accepting heat exchanger 16 to one end of a pulse tube 18. The connection from the regenerator 14 to the pulse tube 18 is through a turning manifold 20 that contains the heat exchanger 16. The opposite end of the pulse tube 18 is connected to a first end of an inertance tube 22 which, as known in the art, is ordinarily constructed so that it is approximately ¼ wavelength long. However, as also known in the art, the inertance tube 22 typically departs in length from precisely ¼ wavelength. The reason for this departure is that it is undesirable to have a velocity node at the pulse tube end of the inertance tube because there would be no gas motion at such a node so the cooler would not work properly. The opposite end of the inertance tube 22 is connected to a compliance reservoir 24. As known in the art, there may be other heat exchangers and all of these connections are both mechanical connections and fluid communication connections. The cooler is charged with and contains a working gas, such as helium, and has a selected operating temperature and operates at a selected mean pressure. The wavelength of acoustic waves in the working gas is determined at the operating temperature and is affected to a much lesser extent by pressure.

The embodiment of FIG. 2 differs from the cooler of FIG. 1 by the substitution of a substantially ¼ wavelength resonator tube 26 for the reservoir 24. The resonator tube 26 can be a separate structure connected in fluid communication to the inertance tube 28 of FIG. 2. It can also have a different passage cross sectional area and shape. However, preferably, the resonator tube 26 is formed integrally with the inertance tube 26 so that together they form a single, integral tube.

Replacing the reservoir with the resonator tube of the invention has several advantages. There is a large industry that makes tubing so it is a relatively fungible product that is readily and inexpensively available. There is no need to design and fabricate a reservoir to operate at the required pressures and temperatures. The resonator tube 26 encloses a considerably smaller volume and has considerably less mass than a reservoir and therefore not only has less weight and takes up less space, but also there is less mass to be cooled down to operating temperatures on start up when the pulse tube cooler is an upper stage of multiple cascaded stages. Therefore, cool down time is reduced. Because this also greatly reduces the total gas volume in the cooler, less working gas flows through the pulse tube, manifold and regenerator during cool down.

Additionally, because the appropriate tubing is conveniently available, and the resonator tube can be formed integrally as an extension of the inertance tube, all that is necessary is to cut a piece of tubing to a length that is substantially ¼λ longer than the designed inertance tube length, sealing and closing one end and attaching the opposite end to the pulse tube in the conventional manner. This provides essentially the same pressure/velocity boundary conditions as desired and found in the prior art when the reservoir is used with the inertance tube.

The term "tube", when applied to the ¼ wave resonator tube of the invention, has a meaning ordinarily implied by the term "tube". It is an elongated body enclosing a hollow interior passage that can contain a fluid. Although most commonly cylindrical, it can have other polygonal cross sectional shapes, such as oval, square, triangular or rectangular. Its length is considerably greater than the lateral dimensions. The important feature of the resonator tube used with the invention is that it function to support a close approximation of an acoustic standing wave inside with a pressure-node and velocity anti-node at the end connecting to the inertance tube and pressure anti-node and velocity node at the opposite, far, closed end. The resonator tube cross-sectional area is not important to wave propagation but of course its length should be an odd, integer multiple of a ¼ wavelength of a standing wave in the working gas within the resonator tube at the operating frequency, temperature and pressure of the resonator tube so that it supports the close approximation of a ¼ wavelength acoustic standing wave. It is desirable to minimize the size and weight of the resonator tube, the volume of working gas it contains and to have a negligible flow resistance. Excessive flow resistance reduces the cooler performance. Excessive weight and tube diameter add weight to the cooler and make winding the tube in a coil difficult. Therefore, the resonator tube cross sectional area is chosen as an engineering tradeoff or compromise by choosing a cross sectional area that avoids the excessive flow resistance resulting from too small a cross sectional area and the excessive size, weight and working gas volume resulting from too great a cross sectional area. We have, for example, used a 4 mm diameter tube and find that it barely affects cooler performance and is small enough to wind into a coil and not add excessive weight. Since the resonator tube is a substitute for a heavier reservoir, a net weight reduction is usually accomplished.

Figure 3:
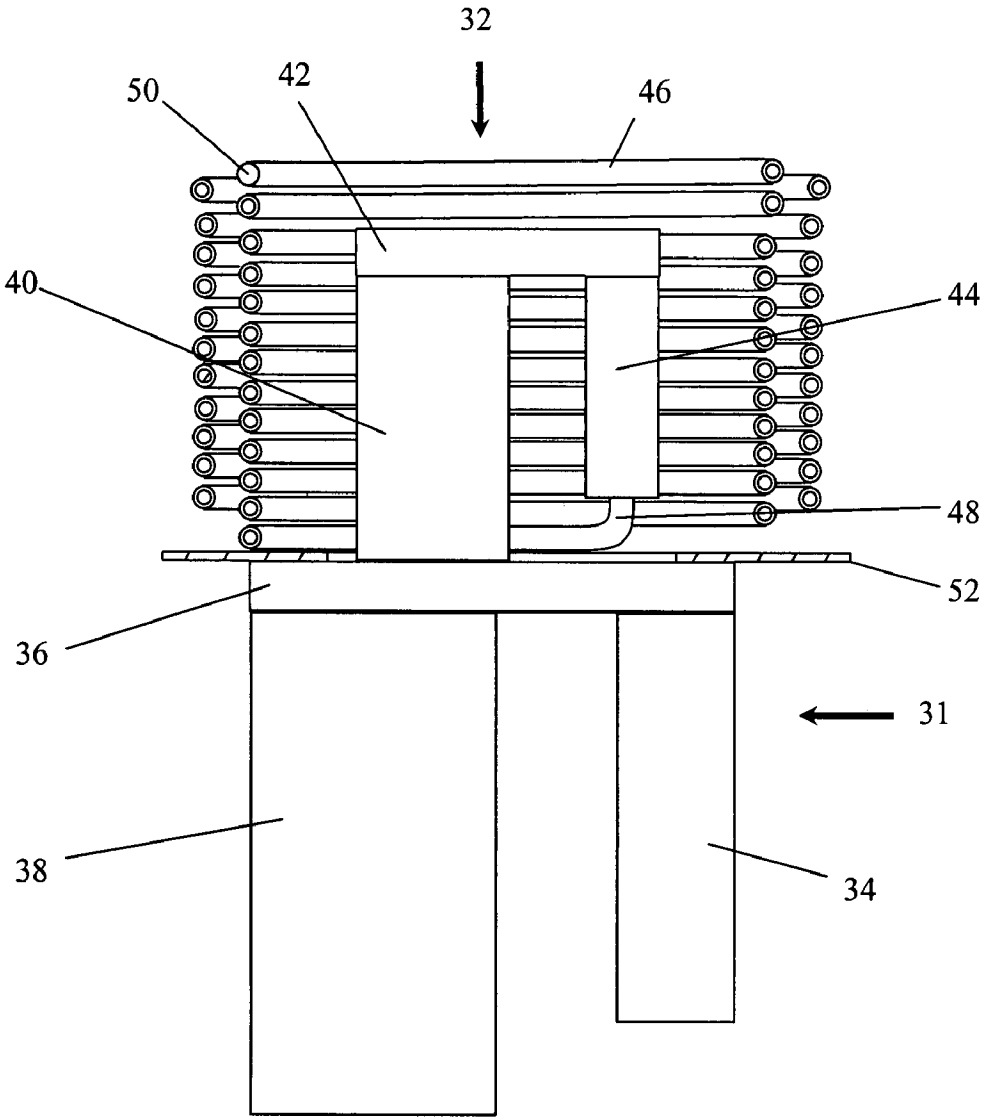
FIG. 3 is a schematic diagram in partial vertical section of a preferred embodiment of the invention.

FIG. 3 shows a cascaded, two stage pulse tube cooler having a first stage cold head 31 and a second stage cold head 32. The first stage has a pulse tube 34, turning manifold 36 and regenerator 38. The second stage regenerator 40, having heat exchangers at its opposite ends, is connected through a turning manifold 42 to the pulse tube 44. The second stage 32 also has an integral tube 46 coiled around and spaced outwardly from the turning manifold 42 of the second stage 32. The turning manifold 42 in the illustrated embodiment is the second stage connection of the regenerator to the pulse tube forming the cold region of the second stage cold head. An open end 48 of the coiled tube 46 is connected to the pulse tube 44 and the opposite end 50 of the coiled tube 46 is closed. The coiled tube 46 has a total length approximately ½ wavelength of acoustic waves. Specifically, the length of the tube 46 is the sum of the ¼ wavelength long resonator tube segment of the coiled tube 46 that is located proximally from the pulse tube 44 and begins at the closed end 50, added to the desired length of an inertance tube designed in accordance with the principle known in the art.

Advantageously, the turns of the tubular coil 46 are soldered or brazed together so they are held in place mechanically and are bonded together along a continuous thermally conductive path. The coil is similarly bonded to an annular plate 52 that is mounted in thermal conduction to the turning manifold 36 of the first stage. This mechanically retains the coil relatively rigid but more importantly provides a thermally conductive path from the entire coil 46 to the cold region of the first stage 31. This thermally conductive path facilitates the conduction of heat from the coil 46 during cool down of the pulse tube cooler.

There are, of course, many alternative ways to coil the tube around the cold head. The turns of the coiled tube can, for example, be wound around or within a cylindrical inner or outer sleeve and can be thermally and mechanically connected to the sleeve.

While certain preferred embodiments of the present invention have been disclosed in detail, it is to be understood that various modifications may be adopted without departing from the spirit of the invention or scope of the following claims.

The invention claimed is:

1. An improved pulse tube cooler including a pressure wave generator, having a selected operating frequency, and connected through a regenerator to one end of a pulse tube, the opposite end of the pulse tube connected to a first end of an inertance tube, the cooler having a selected operating temperature and containing a working gas for operating at a selected mean pressure, wherein the improvement comprises:

a resonator tube having a first end connected to the opposite, second end of the inertance tube and having an opposite, second end that is sealingly closed, the resonator tube having a length substantially equal to an odd, integer multiple of a ¼ wavelength of a standing wave in the working gas within the resonator tube at the operating frequency, temperature and pressure of the resonator tube.

2. A pulse tube cooler in accordance with claim 1, wherein the integer multiplier is 1.

3. A pulse tube cooler in accordance with claim 2 wherein the resonator tube is formed integrally with the inertance tube as a single, integral tube.

4. A pulse tube cooler in accordance with claim 3 wherein the length of the integral tube is substantially ½ of said wavelength.

5. A pulse tube cooler in accordance with claim 3 wherein the integral tube is spaced outwardly from and coiled around the connection of the regenerator to the pulse tube at a cold region of a cooler that is at least a second stage of a multi-stage cooler.

6. A pulse tube cooler in accordance with claim 5 wherein the coil has turns that are thermally bonded together to improve heat conduction through the coil.

7. A pulse tube cooler in accordance with claim 2 wherein the inertance tube and the resonator tube are spaced outwardly from and coiled around the connection of the regenerator to the pulse tube at a cold region of a cooler that is at least a second stage of a multi-stage cooler.

8. A pulse tube cooler in accordance with claim 7 wherein the coil has turns that are thermally bonded together to improve heat conduction through the coil.

* * * * *